US012485330B1

(12) United States Patent
Estupiña Blasco

(10) Patent No.: US 12,485,330 B1
(45) Date of Patent: Dec. 2, 2025

(54) BALL LAUNCHING NET POST SYSTEM

(71) Applicant: Sergi Andreu Estupiña Blasco, Coral Gables, FL (US)

(72) Inventor: Sergi Andreu Estupiña Blasco, Coral Gables, FL (US)

( * ) Notice: Subject to any disclaimer, the term of this patent is extended or adjusted under 35 U.S.C. 154(b) by 0 days.

(21) Appl. No.: 19/270,320

(22) Filed: Jul. 15, 2025

(51) Int. Cl.

| | |
|---|---|
| ***A63B 61/02*** | (2006.01) |
| ***A63B 69/40*** | (2006.01) |
| ***A63B 71/06*** | (2006.01) |
| ***A63B 102/08*** | (2015.01) |

(52) U.S. Cl.
CPC ..... *A63B 61/02* (2013.01); *A63B 69/406* (2013.01); *A63B 71/0622* (2013.01); *A63B 2071/0683* (2013.01); *A63B 2102/08* (2015.10); *A63B 2220/75* (2013.01); *A63B 2220/76* (2013.01); *A63B 2225/093* (2013.01)

(58) Field of Classification Search
CPC ..... A63B 61/02; A63B 69/38; A63B 69/40; A63B 69/406; A63B 2069/402; A63B 2069/403; A63B 2069/404; A63B 2069/405
USPC ..... 473/492, 493; 124/78
See application file for complete search history.

(56) References Cited

U.S. PATENT DOCUMENTS 4,092,024 A * 5/1978 Hoover ..... A63B 61/02 256/37
5,358,257 A * 10/1994 Pardi ..... A63B 61/02 473/493
6,085,735 A * 7/2000 Cheek, Jr. ..... F41B 11/71 124/73
6,732,724 B1 * 5/2004 Paulson ..... A63B 69/406 124/78
7,445,003 B2 * 11/2008 Smith ..... A63B 69/406 124/78
7,736,249 B2 * 6/2010 Zhang ..... F41B 11/52 124/78
11,389,710 B2 * 7/2022 Voloshin ..... A63B 47/024
2023/0218969 A1 * 7/2023 Weinlader ..... A63B 69/406 473/436

* cited by examiner

*Primary Examiner* — Joseph B Baldori
(74) *Attorney, Agent, or Firm* — Ruben Alcoba, Esq.

(57) ABSTRACT

A ball launching net post system for ball courts integrates automated ball launching, environmental monitoring, net tension control, and weatherproofing within a pair of multifunctional net posts. Each net post houses a ball launcher comprising opposing wheels driven by servomotors to propel balls through apertures in the post. Controllers integrated into each net post monitor court humidity, wind, and weather conditions while enabling remote operation of the ball launchers via smartphone or smartwatch. A weatherproofing system enhances ventilation and prevents water intrusion, safeguarding internal components. The system includes a net tension mechanism and height sensor, connected to the controllers, to maintain net height automatically. Adjustable ball trajectories are achieved by varying launcher wheel speeds and housing tilt angles. The ball launching net post system maximizes court space, improves practice versatility, and increases equipment durability by transforming passive net posts into intelligent, active court infrastructure.

10 Claims, 10 Drawing Sheets

BALL LAUNCHING NET POST SYSTEM

BACKGROUND

The present invention is directed to a ball launching net post system for improved functionality, durability and operational reliability that is used to play padel tennis. The system eliminates the need for the players to carry the balls within the uniform during practice and offers a range of additional functionalities that will be described below. It is foreseen that the same system can be used in other sports or games that have a net dividing the playing filed. U.S. Pat. No. 11,872,456 B1 to Sergi Andreu Estupina Blasco (issued on Jan. 16, 2024) discloses a similar design. While such prior art design also addresses the need to free the players from carrying the balls within the uniform during practice and offers a similar range of additional functionalities, it presents disadvantages that limit its functional and operational potential, such as the impossibility of adjusting and thus customizing the ball launching trajectory and the lack of a comprehensive and optimized weatherproofing system for ventilating the electronics that are integrated into the system and protecting them from weather borne water intrusion. The present invention addresses these disadvantages and therefore represents an improvement over the referred prior art design.

Ball sports such as padel, tennis and similar net-based games frequently require repetitive ball delivery for training, practice, and recreational play. Traditionally, ball machines positioned courtside have been employed to facilitate consistent ball launching toward a player. However, conventional ball machines are standalone units that occupy court space, lack integration with existing court infrastructure, and are often susceptible to environmental conditions such as moisture, humidity, and wind, which can adversely affect performance and longevity.

Moreover, net posts on ball courts typically serve a singular, passive function: supporting the net at a designated height. Modern training and match environments demand more intelligent, multifunctional equipment capable of interacting with players, adapting to court conditions, and optimizing practice efficiency. Current solutions fail to offer integrated systems that combine ball launching, court condition monitoring, and net height management within the existing net post architecture.

Additionally, conventional ball machines often require manual adjustments to launch angles and ball trajectories, and they typically do not offer customizable or remote-controlled launching sequences. This limits training versatility and player convenience. Furthermore, existing systems generally lack adequate weatherproofing, resulting in accelerated wear and reduced operational reliability in outdoor or humid environments.

Therefore, there exists a need for a multifunctional, durable, and reliable ball launching net post system that integrates automated ball launching mechanisms, environmental monitoring, and net tensioning functionalities directly within the net posts, while providing effective weatherproofing and remote controllability. Such a system would optimize court space utilization, improve training quality, and enhance overall operational durability in diverse environmental conditions.

SUMMARY

The primary object of the present invention is to provide a ball launching net post system for improved functionality, durability, and operational reliability in ball courts. The invention integrates automated ball launching mechanisms, environmental condition monitoring, net tension management, and weatherproofing features directly into the structural net posts of a ball court, thereby optimizing court space utilization and enhancing player experience.

To achieve this object, the invention provides a ball launching net post system comprising a pair of specially configured net posts, each having an inner chamber, multiple defined apertures, and an integrated ball launching apparatus. Each net post houses a ball launcher, which utilizes opposing rotating wheels to propel balls through a dedicated aperture in the post. The ball launcher receives balls via a ball chute attached to the net post and can adjust ball launching angles either mechanically or electronically.

The system further includes a controller integrated into each net post, featuring a display, transceiver, and processor configured to monitor court humidity, wind, and weather conditions. The controller allows players to remotely operate the ball launching system using a remote device such as a smartphone or smartwatch. The system provides customizable ball launching trajectories, including ascending and descending shots, through independent control of the spinning speeds of the launcher wheels.

Another object of the invention is to enhance operational reliability by integrating a weatherproofing system within each net post. This system employs passive-active ventilation driven by an electric fan and a specially designed top cap to manage airflow through the inner chamber and prevent weather borne water intrusion. Drainage channels within the top cap further protect internal components by collecting and discharging infiltrating water.

Additionally, the invention includes a net tension mechanism within each net post, connected to the controller, to maintain the playing net at a proper height. A height sensor integrated into each net post enables automatic monitoring and adjustment of net tension to meet regulation or preferred training conditions.

Overall, the present invention provides a novel and multifunctional net post system that replaces conventional passive net posts with intelligent, active infrastructure capable of ball launching, court condition monitoring, net height management, and weather protection, thereby greatly improving the versatility, durability, and reliability of court installations for recreational, training, and competitive use.

BRIEF DESCRIPTION OF THE DRAWINGS

These and other features, aspects, and advantages of the present invention will become better understood with regards to the following description, appended claims, and drawings where:

As seen in FIGS. 1-9, the present invention is a ball launching net post system 1 for improved functionality, durability and operational reliability.

Figure 1:
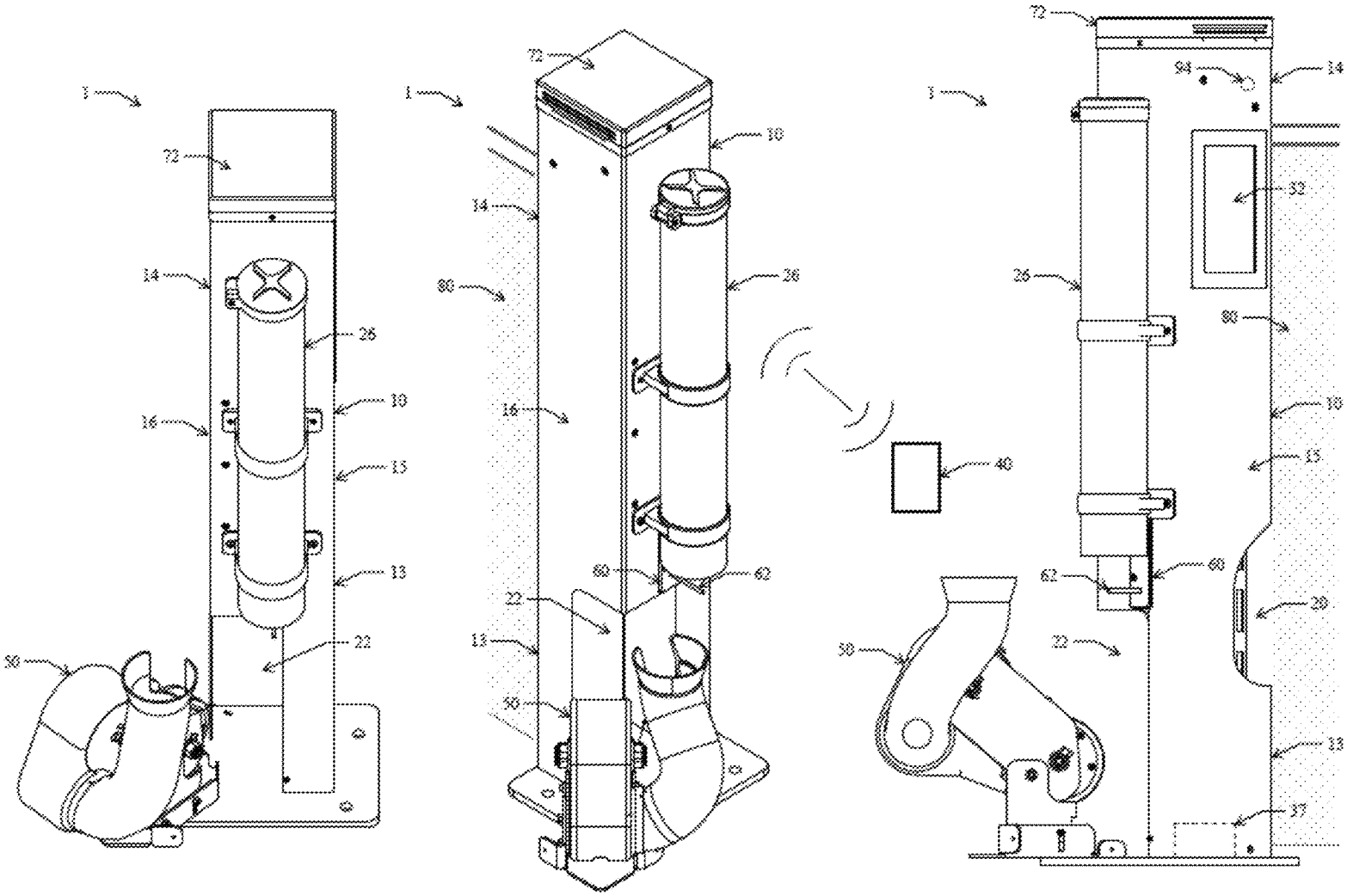
FIG. 1 includes perspective views of the ball launching net post system.
Figure 2:
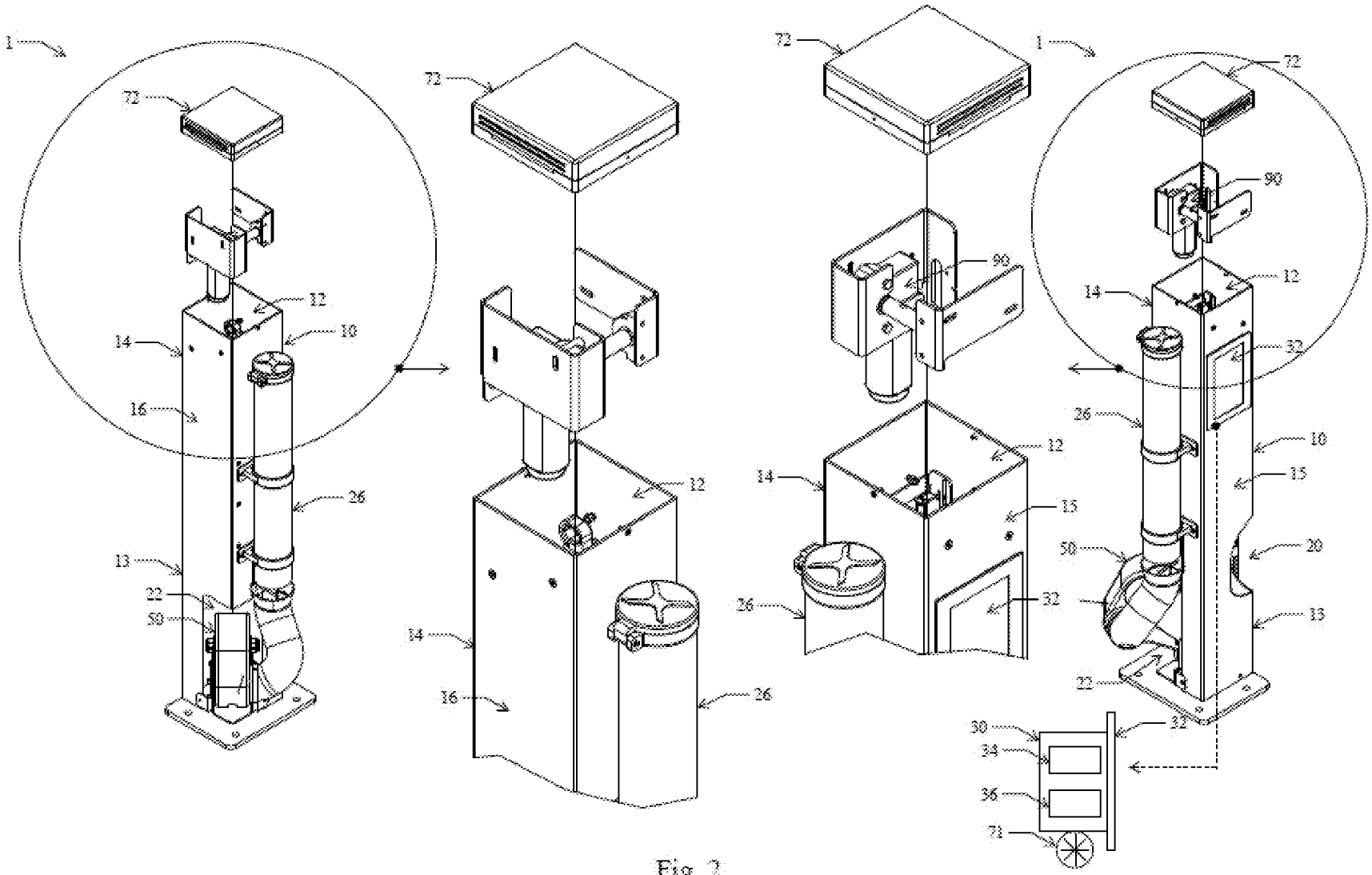
FIG. 2 includes exploded perspective views of the ball launching net post system and enlarged views of its upper section.
Figure 3:
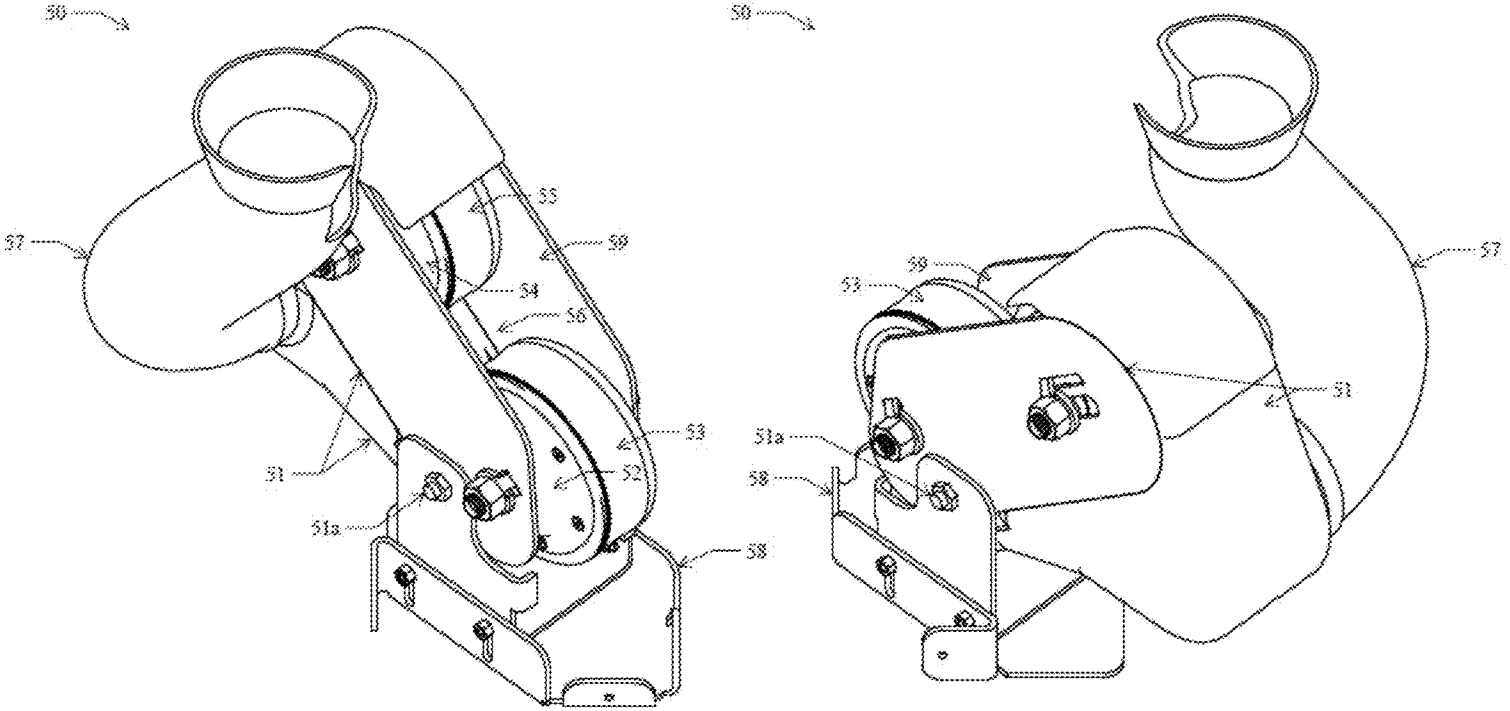
FIG. 3 includes perspective views of the ball launcher.
Figure 4:
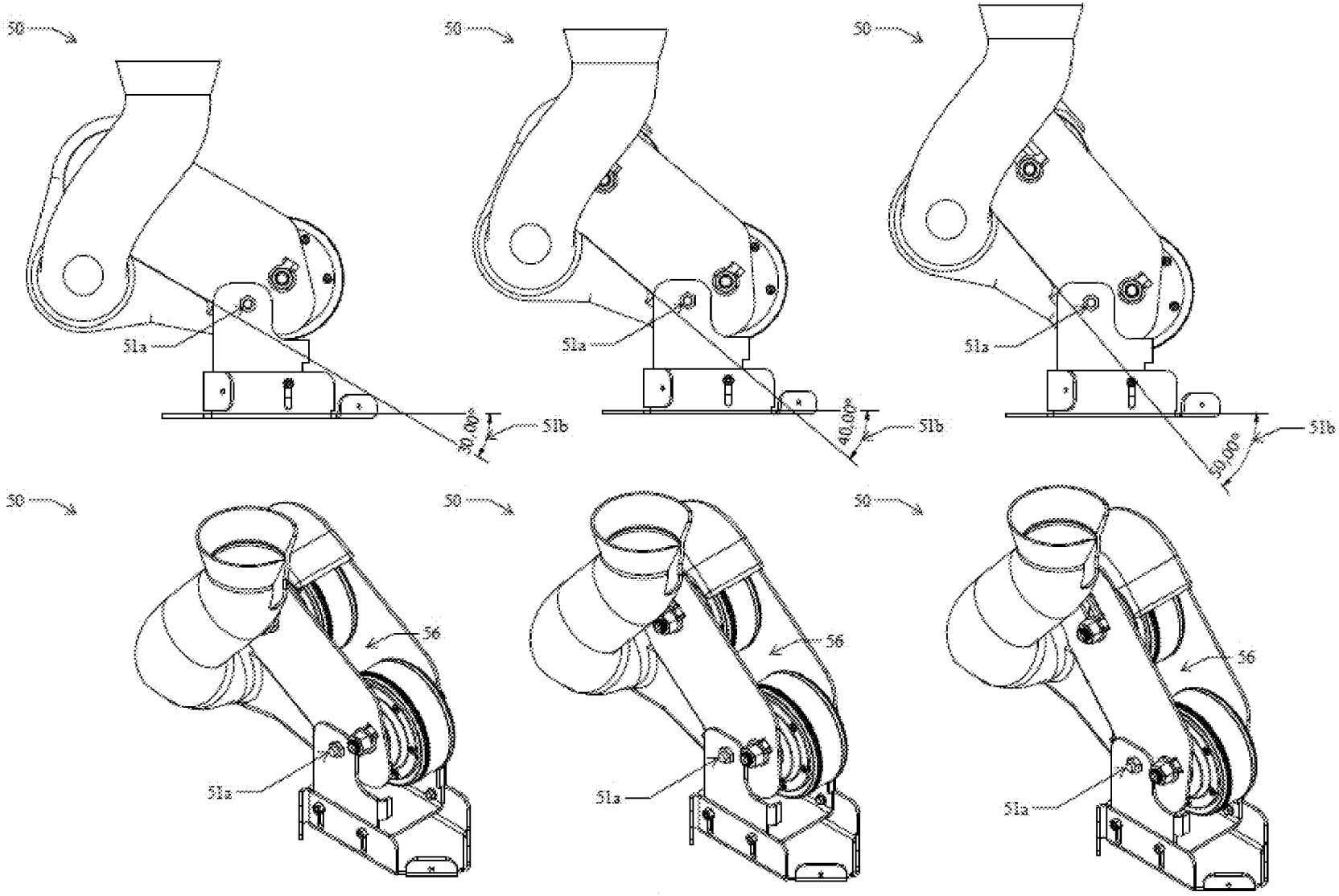
FIG. 4 includes elevation views and corresponding perspective views of the ball launcher tilted at different angles.
Figure 5:
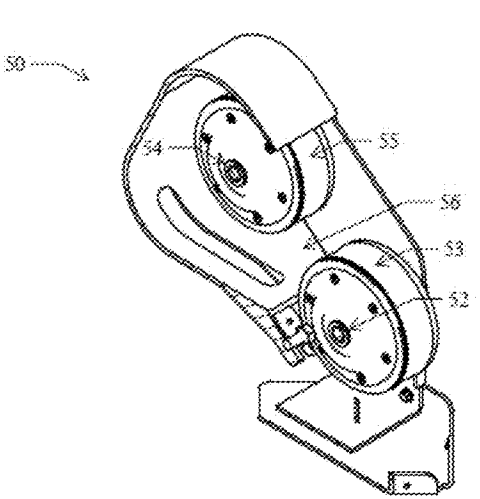
FIG. 5 includes a plan view and cross sectional perspective views of the ball launcher.
Figure 5:
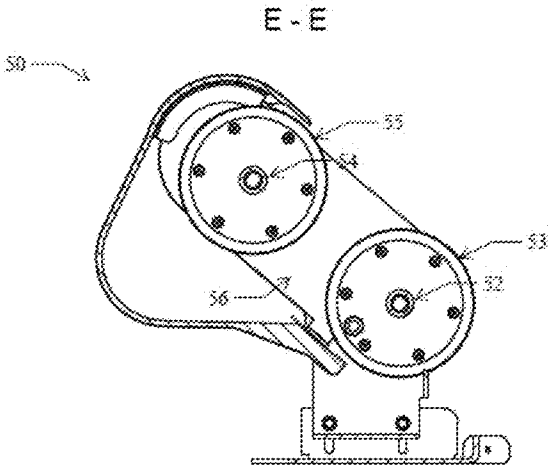
Figure 5:
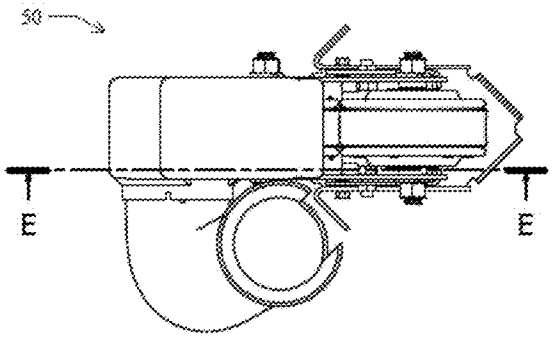
Figure 6:
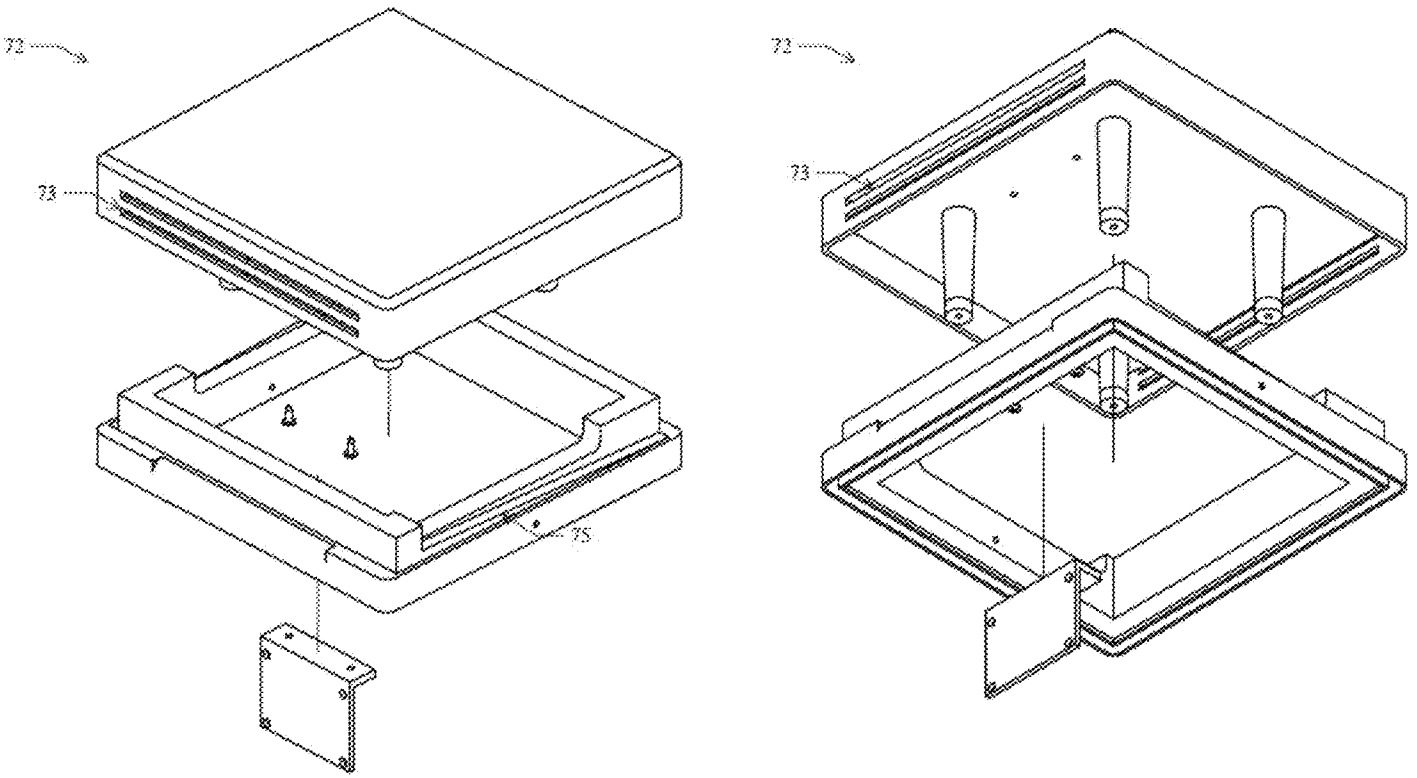
FIG. 6 includes exploded perspective views of the top cap of the weathering proofing system.
Figure 7:
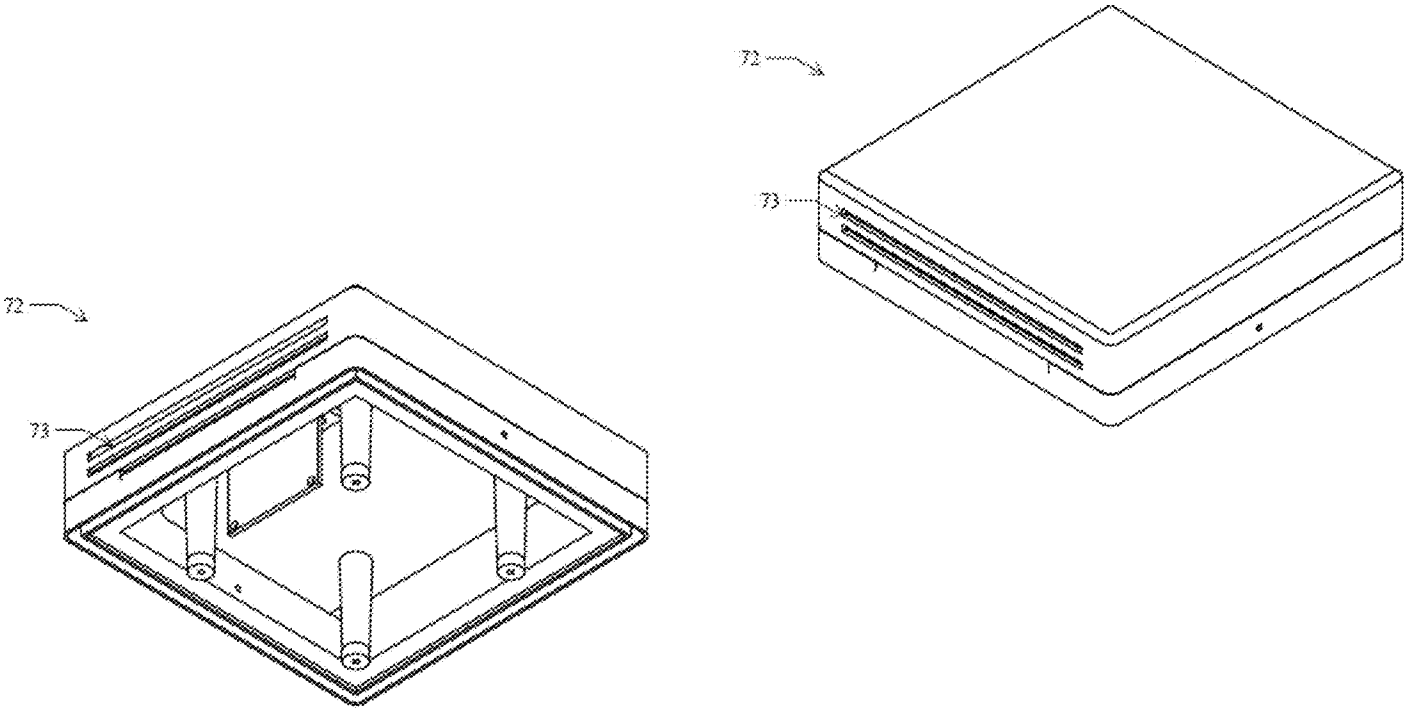
FIG. 7 includes perspective views of the top cap of the weathering proofing system.
Figure 8:
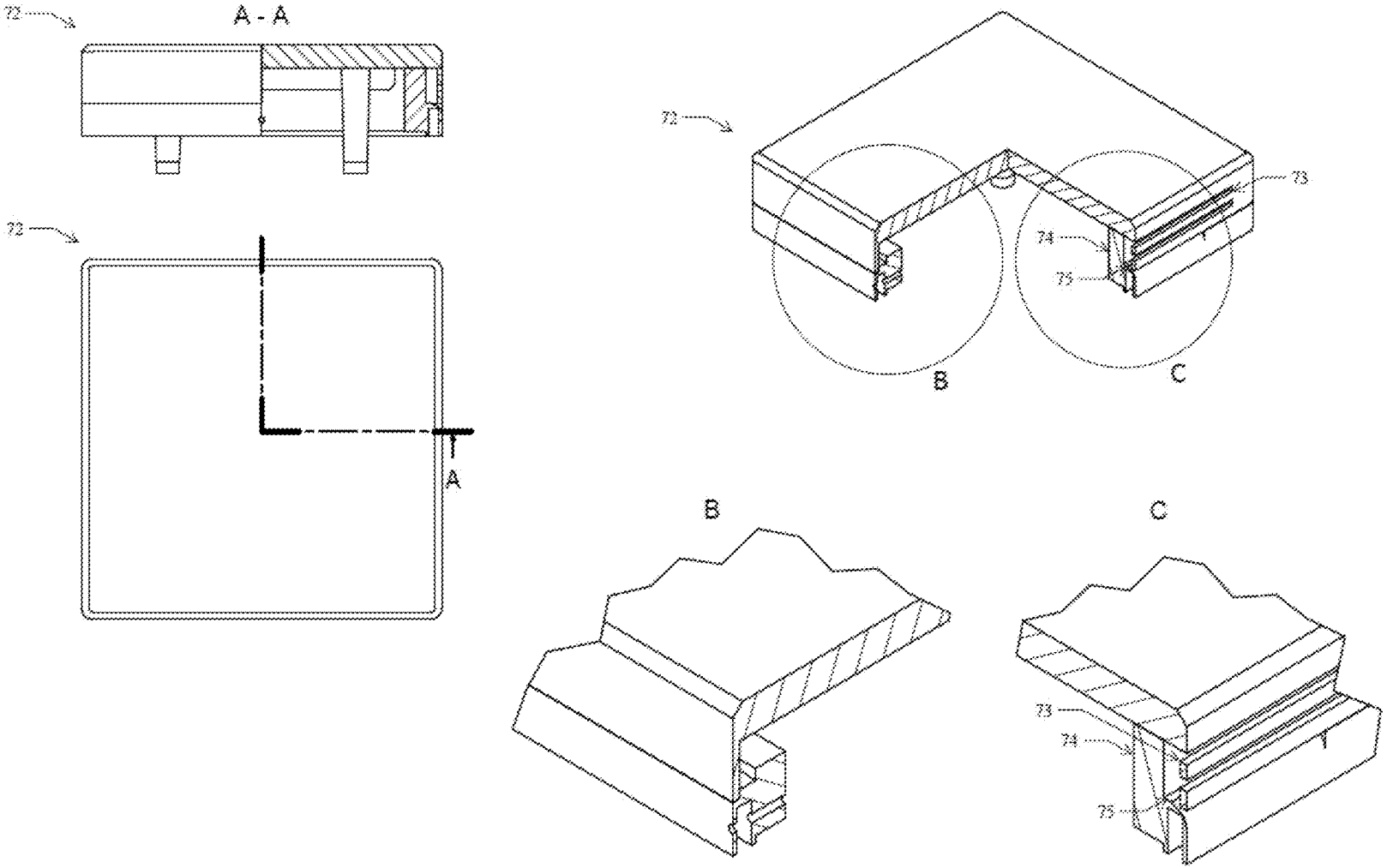
FIG. 8 includes a plan view, a cross sectional elevation view and cross sectional perspective views of the top cap of the weathering proofing system.
Figure 9:
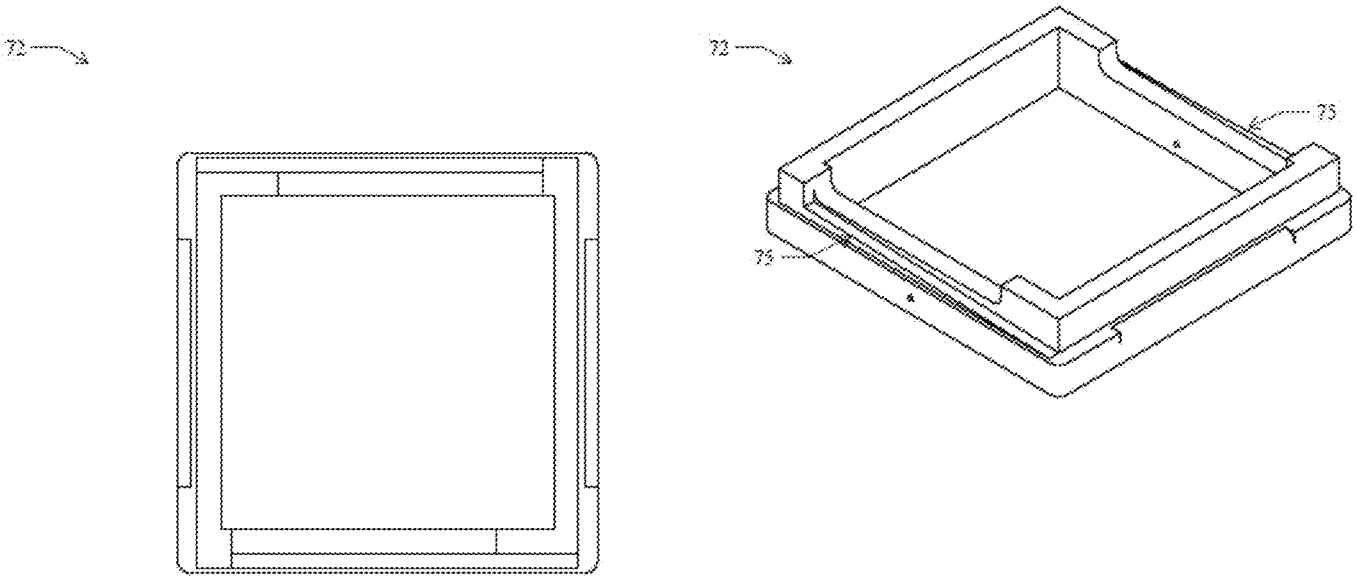
FIG. 9 includes a cross sectional plan view and a cross sectional perspective view of the top cap of the weathering proofing system.
Figure 10:
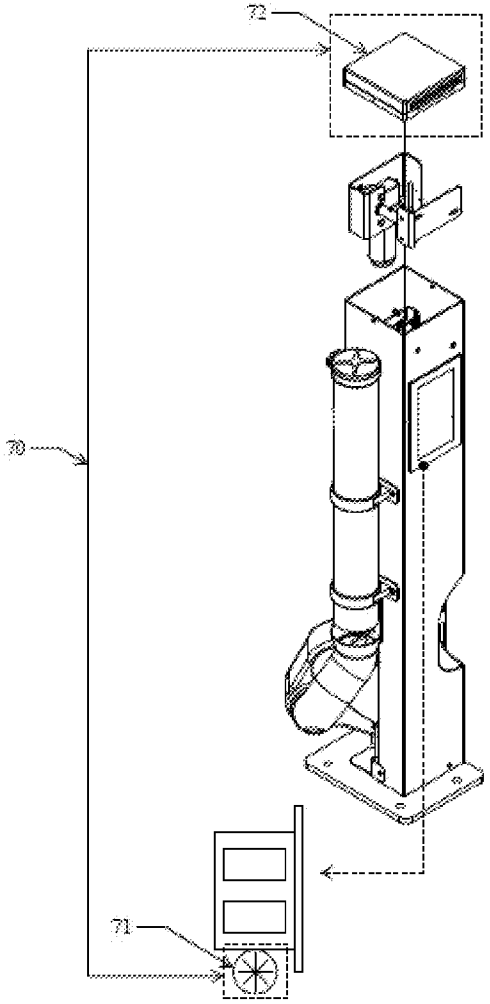
FIG. 10 includes an exploded perspective view of the ball launching net post system, highlighting the components of the weatherproofing system description.

The ball launching net post system 1 comprises a pair of net posts 10, each net post 10 has an inner chamber 12, a lower section 13, an upper section 14, a front side 15, a rear side 16, a left lateral side 17 and a right lateral side 18, each net post 10 defines an upper aperture 19, a ball launching aperture 20 and a ball launcher aperture 22, the ball launching aperture 20 is positioned between the front side 15 and the right lateral side 18, the ball launcher aperture 22 is positioned in the lower section 13 between the rear side 16 and the left lateral side 18, each net post 10 is configured to be secured at a mid-lateral section of a court. A pair of ball launchers 50, each ball launcher 50 has a housing 51 and a ball receiver 57, the housing 51 is supported on a base 58 and encloses a first servomotor 52 that has a first wheel 53 that spins counterclockwise and a second servomotor 54 that has a second wheel 55 that spins clockwise, a space 56 separates the first wheel 53 and the second wheel 55 and is configured to receive a ball, the housing 51 defines a housing aperture 59 that is aligned with the space 56, the ball receiver 57 is configured to receive a ball and introduce it into the housing 51, the housing 51 is configured to guide the ball into the space 56, each ball launcher 50 is placed at the lower section 13 of each net post 10 with the housing encased in the inner chamber 12, the housing aperture 59 aligned with the ball launching aperture 20 and the ball receiver 57 protruding from the ball launcher aperture 22, the spinning of the first wheel 53 and the second wheel 55, which is controlled by the first servomotor 52 and the second servomotor 54, respectively, launches the ball in the space 56 through the ball launcher aperture 22 to a player in the court. A pair of ball chutes 26, each ball chute 26 is attached to the left lateral side 17 of each net post 10 and is configured to controllably feed balls into the ball receiver 57 of each ball launcher 50 through a lever 62 that is actuated by a third servomotor 60. A pair of controllers 30, each controller 30 has a display 32, a transceiver 34 and a processor 36 that is configured to measure the humidity of the court and the wind and weather conditions affecting the court, each controller 30 is placed at the upper section 14 of each net post 10 with the display 32 integrated onto the front side 15 and the transceiver 34 and the processor 36 enclosed in the inner chamber 12, each controller 30 is connected to a power source 37 in the court and is configured to receive commands from a remote 40 that will allow the player to remotely request the launching of balls from each ball launcher 50. A pair of weatherproofing systems 70, each weatherproofing system 70 is configured to provide passive-active ventilation for each controller 30 by enhancing the naturally occurring convection-driven circulation of ambient air through the inner chamber 12 of each net post 10, from the lower section 13 to the upper section 14, each weatherproofing system 70 is further configured to partially waterproof the inner chamber 12 of each net post 10 to shield each controller 30 from weatherborne water intrusion. And, a net 80 that is attached to the pair of net posts 10. Wherein each ball launcher 50 can adjust the ball launching angle through the mechanical tilt 51*b* of the housing 51, the remote electronic adjustment of selectively differing spinning speeds of the first wheel 53 and the second wheel 55 via the remote 40, or both. And, wherein each weatherproofing system 70 has an electric fan 71 and a top cap 72, the electric fan 71 is placed in the inner chamber 12 of each net post 10 and drives ambient air from the ball launching aperture 20, the ball launcher aperture 22, or both through the controller 30, the top cap 72 closes the upper aperture 19 of each net post 10 and has at least one exhaust grille 73 configured to discharge the ambient air that has been driven through and heated by thermal exchange with the controller 30, the top cap 72 integrates at least one backwall 74 that prevents weatherborne water intrusion into the inner chamber 12 of each net post 10 through the at least one exhaust grille 73, the top cap 72 further integrates at least one drainage channel 75 that collects weatherborne water infiltrating through the at least one exhaust grille 73 and passively discharges it from the net post 10 by gravity.

In an embodiment of the present invention, the mechanical tilt 51*b* of the housing 51 of each ball launcher 50 is adjusted by rotating the housing 51 about a transverse axis 51*a*.

In another embodiment of the present invention, the transverse axis 51*a* has a progressive blocking mechanism that allows for the continuous angular adjustability of the housing 51 within a defined tilt range.

In another embodiment of the present invention, the progressive blocking mechanism has a set of perforated semicircular plates that define multiple angular positions that can be selectively secured by bolts or pins.

In another embodiment of the present invention, the mechanical tilt 51*b* of the housing 51 of each ball launcher 50 can be adjusted to accommodate fabrication and assembly tolerances of the ball launching net post system 1.

In another embodiment of the present invention, each controller 30 is configured to generate ascending ball launching trajectories by spinning the one of the first wheel 53 and the second wheel 55 of each ball launcher 50 that is positioned higher at a greater speed.

In another embodiment of the present invention, each controller 30 is configured to generate descending ball launching trajectories by spinning the one of the first wheel 53 and the second wheel 55 of each ball launcher 50 that is positioned lower at a greater speed.

In another embodiment of the present invention, each controller 30 is configured to provide a customizable set of ball launching trajectories.

In another embodiment of the present invention, each controller 30 is configured to control the illumination of the court.

In another embodiment of the present invention, the ball launching net post system 1 comprises a net tension mechanism 90 in the upper section 14 of each net post 10 that attaches to the net 80 and is configured to operatively connect to each controller 30 to maintain the net 80 at a playing height.

In another embodiment of the present invention, the ball launching net post system 1 comprises a sensor 94 in the upper section 14 of each net post 10 that measures the height of the net 80 and is configured to operatively connect to each controller 30.

In another embodiment of the present invention, the remote 40 is a smartwatch.

In yet another embodiment of the present invention, the remote 40 is a smartphone.

An advantage of the present invention is that it integrates ball launching mechanisms directly into the net posts of a ball court, thereby eliminating the need for standalone ball machines that occupy valuable court space. This integrated design provides a cleaner, unobstructed playing area while ensuring consistent ball delivery for practice and recreational play without interfering with the court's primary layout.

Another advantage of the present invention is that it enables customizable ball launching trajectories through both mechanical and electronic adjustments of the ball launchers' wheel speeds and housing angles. This allows players to simulate a wide variety of shot types and trajectories, including ascending and descending balls, improving training versatility and replicating match-like conditions more accurately.

Another advantage of the present invention is that it incorporates intelligent environmental monitoring within each net post controller, allowing real-time measurement of humidity, wind, and weather conditions affecting the court. This information can be used to adjust ball launching parameters, inform practice scheduling, and enhance safety, especially in outdoor or variable environments.

Another advantage of the present invention is that it features a comprehensive weatherproofing system integrated within each net post, combining passive-active ventilation with protective top caps and drainage channels. This system safeguards sensitive electronic components, such as the controllers, from weather borne water intrusion, thus improving the operational durability and lifespan of the system in both indoor and outdoor settings.

Another advantage of the present invention is that it introduces an automated net tension mechanism and net height sensor into the net posts, enabling real-time monitoring and adjustment of net height via the integrated controller. This ensures that the net remains at regulation or customized training heights without the need for manual intervention, enhancing gameplay consistency and reducing maintenance requirements.

Another advantage of the present invention is that it allows remote control operation via devices such as smartphones and smartwatches, providing players with convenient, immediate control over ball launching functions and court settings. This remote capability enhances player autonomy, reduces downtime during practice sessions, and facilitates solo training without the need for additional personnel.

Still another advantage of the present invention is that it improves the overall functionality, durability, and operational reliability of ball court installations by transforming traditionally passive net posts into intelligent, multifunctional infrastructure. The invention's integrated systems reduce equipment clutter, enhance player experience, and increase the versatility of the court for varied training, recreational, and competitive applications.

The embodiments of the ball launching net post system for improved functionality, durability and operational reliability herein are exemplary and numerous modifications, combinations, variations, and rearrangements can be readily envisioned to achieve an equivalent result, all of which are intended to be embraced within the scope of the appended claims. Further, nothing in the above-provided discussions of the ball launching net post system for improved functionality, durability and operational reliability should be construed as limiting the invention to an embodiment or a combination of embodiments. The scope of the invention is defined by the description, drawings, and claims.

What is claimed is:

1. A ball launching net post system for improved functionality, durability and operational reliability, the ball launching net post system comprises:

a pair of net posts, each net post has an inner chamber, a lower section, an upper section, a front side, a rear side, a left lateral side and a right lateral side, each net post defines an upper aperture, a ball launching aperture and a ball launcher aperture, the ball launching aperture is positioned between the front side and the right lateral side, the ball launcher aperture is positioned in the lower section between the rear side and the left lateral side, each net post is configured to be secured at a mid-lateral section of a court;

a pair of ball launchers, each ball launcher has a housing and a ball receiver, the housing is supported on a base and encloses a first servomotor that has a first wheel that spins counterclockwise and a second servomotor that has a second wheel that spins clockwise, a space separates the first wheel and the second wheel and is configured to receive a ball, the housing defines a housing aperture that is aligned with the space, the ball receiver is configured to receive a ball and introduce it into the housing, the housing is configured to guide the ball into the space, each ball launcher is placed at the lower section of each net post with the housing encased in the inner chamber, the housing aperture aligned with the ball launching aperture and the ball receiver protruding from the ball launcher aperture, the spinning of the first wheel and the second wheel, which is controlled by the first servomotor and the second servomotor, respectively, launches the ball in the space through the ball launcher aperture to a player in the court;

a pair of ball chutes, each ball chute is attached to the left lateral side of each net post and is configured to controllably feed balls into the ball receiver of each ball launcher through a lever that is actuated by a third servomotor;

a pair of controllers, each controller has a display, a transceiver and a processor, each controller is placed at the upper section of each net post with the display integrated onto the front side and the transceiver and the processor enclosed in the inner chamber, each controller is connected to a power source in the court and is configured to receive commands from a remote that will allow the player to remotely request the launching of balls from each ball launcher;

a pair of weatherproofing systems, each weatherproofing system is configured to provide ventilation for each controller by enhancing the naturally occurring convection-driven circulation of ambient air through the inner chamber of each net post, from the lower section to the upper section, each weatherproofing system is further configured to partially waterproof the inner chamber of each net post; and a net that is attached to the pair of net posts;

wherein each ball launcher can adjust the ball launching angle through a mechanical tilt of the housing, the remote electronic adjustment of selectively differing spinning speeds of the first wheel and the second wheel via the remote, or both; and wherein each weatherproofing system has an electric fan and a top cap, the electric fan is placed in the inner chamber of each net post and drives ambient air from the ball launching aperture, the ball launcher aperture, or both through the controller, the top cap closes the upper aperture of each net post and has at least one exhaust grille configured to discharge the ambient air that has been driven through and heated by thermal exchange with the controller, the top cap integrates at least one backwall that prevents weather borne water intrusion into the inner chamber of each net post through the at least one exhaust grille, the top cap further integrates at least one drainage channel that collects weather borne water infiltrating through the at least one exhaust grille and passively discharges it from the net post by gravity.

2. The ball launching net post system for improved functionality, durability and operational reliability of claim 1, wherein the mechanical tilt of the housing of each ball launcher is adjusted by rotating the housing about a transverse axis.

3. The ball launching net post system for improved functionality, durability and operational reliability of claim 1, wherein each controller is configured to generate ascending ball launching trajectories by spinning the one of the first wheel and the second wheel of each ball launcher that is positioned higher at a greater speed.

4. The ball launching net post system for improved functionality, durability and operational reliability of claim 1, wherein each controller is configured to generate descending ball launching trajectories by spinning the one of the first wheel and the second wheel of each ball launcher that is positioned lower at a greater speed.

5. The ball launching net post system for improved functionality, durability and operational reliability of claim 1, wherein each controller is configured to provide a customizable set of ball launching trajectories.

6. The ball launching net post system for improved functionality, durability and operational reliability of claim 1, wherein each controller is configured to control the illumination of the court.

7. The ball launching net post system for improved functionality, durability and operational reliability of claim 1, wherein the ball launching net post system comprises a net tension mechanism in the upper section of each net post that attaches to the net and is configured to operatively connect to each controller to maintain the net at a playing height.

8. The ball launching net post system for improved functionality, durability and operational reliability of claim 1, wherein the ball launching net post system comprises a sensor in the upper section of each net post that measures the height of the net and is configured to operatively connect to each controller.

9. The ball launching net post system for improved functionality, durability and operational reliability of claim 1, wherein the remote is a smartwatch.

10. The ball launching net post system for improved functionality, durability and operational reliability of claim 1, wherein the remote is a smartphone.

* * * * *